US007502735B2

(12) United States Patent
Ehara

(10) Patent No.: US 7,502,735 B2
(45) Date of Patent: Mar. 10, 2009

(54) SPEECH SIGNAL TRANSMISSION APPARATUS AND METHOD THAT MULTIPLEX AND PACKETIZE CODED INFORMATION

(75) Inventor: Hiroyuki Ehara, Yokohama (JP)

(73) Assignee: Panasonic Corporation, Osaka (JP)

( * ) Notice: Subject to any disclaimer, the term of this patent is extended or adjusted under 35 U.S.C. 154(b) by 755 days.

(21) Appl. No.: 10/923,700

(22) Filed: Aug. 24, 2004

(65) Prior Publication Data

US 2005/0060143 A1 Mar. 17, 2005

(30) Foreign Application Priority Data

Sep. 17, 2003 (JP) ..... 2003-325001

(51) Int. Cl.
*G10L 19/12* (2006.01)

(52) U.S. Cl. ..... 704/228

(58) Field of Classification Search ..... 704/228
See application file for complete search history.

(56) References Cited

U.S. PATENT DOCUMENTS 6,301,222 B1 * 10/2001 Kovacevic et al. ..... 370/216
6,795,534 B2 * 9/2004 Noguchi ..... 379/88.17
2002/0169859 A1 11/2002 Serizawa

FOREIGN PATENT DOCUMENTS

JP 2002268697 9/2002
JP 2002-542521 12/2002
JP 2003-202898 7/2003
WO WO 00/63885 10/2000

OTHER PUBLICATIONS

C. Montminy, et al.; "Improving the Performance of ITU-T G.729A for VoIP," IEEE 2000, p. 433.
J. Sjoberg, et al.; "Real-Time Transport Protocol (RTP) Payload Format and File Storage Format for the Adaptive Multi-Rate (AMR) and Adaptive Multi-Rate Wideband (AMR-WB) Audio Codecs," IETF Standard RFC3267, Jun. 2002, pp. 1-49.
3GPP TS 26.091 V4.0.0 (Mar. 2001), 3rd Generation Partnership Project; Technical Specification Group Services and System Aspects; Mandatory Speech Codec speech processing functions; AMR speech codec; Error concealment of lost frames (Release 4).
Japanese Office Action dated Jul. 22, 2008 with partial English translation thereof.
M. Serizawa, et al., "A Packet Loss Recovery Method Using Packet Arrived Behind the Playout Time for CELP Decoding," Acoustics, Speech, and Signal Processing, 2002. Proceedings, (ICASSP '02), IEEE International Conference on, 2002, vol. 1, pp. I-169-I-172.

* cited by examiner

*Primary Examiner*—Susan McFadden
(74) *Attorney, Agent, or Firm*—Dickinson Wright, PLLC

(57) ABSTRACT

A speech signal transmission apparatus multiplexes, packetizes, and sends first coded information coded in a normal state and second coded information used for improving the quality of decoded speech when a frame loss occurs. A first error calculating section calculates a first error signal between a target signal and a synthesized signal generated by an adaptive codebook, and a second error calculating section calculates a second error signal between the target signal and a synthesized signal generated by a fixed codebook. An error signal ratio calculating section calculates the ratio of the first error signal to the second error signal. A speech frame classifying section classifies a speech frame according to the magnitude of the ratio, and a decision section decides whether or not to multiplex the second coded information based on the classification result.

3 Claims, 12 Drawing Sheets

SPEECH SIGNAL TRANSMISSION APPARATUS AND METHOD THAT MULTIPLEX AND PACKETIZE CODED INFORMATION

BACKGROUND OF THE INVENTION

1. Field of the Invention

The present invention relates to a communication system which transmits coded speech information, and more particularly, to a speech signal transmission system and speech signal transmission method for packetizing and transmitting parameters which are coded using CELP type speech coding.

2. Description of the Related Art

Conventionally, in packet communication represented by Internet communication, when, for example, packets are lost in a transmission channel and the decoder side cannot receive coded information, packet loss concealment processing is generally carried out. As one of techniques handling such a packet loss, a scheme shown in FIG. 1 is known.

The transmitting side carries out processing on the digital speech signal input in units of a frame of several tens of ms. In FIG. 1, F(n) denotes coded data of an nth frame and P(n) denotes an nth payload packet.

FIG. 1 shows how coded data of two consecutive frames are multiplexed into one packet and transmitted from the transmitting side to the receiving side. Since the frames multiplexed into the same packet are shifted by one frame at a time, coded data of each frame is transmitted twice from the transmitting side to receiving side using different packets.

After demultiplexing of packets, the receiving side carries out decoding processing using coded data of one of the two received frames (a lower frame number in the figure). When there is no packet loss, all coded data which has been superimposed and transmitted becomes useless, and since two frames are multiplexed together, transmission delay increases by one frame compared to the case where transmission is performed frame by frame.

However, even when there is a packet loss, if only one packet is lost as shown in FIG. 2, it is possible to use coded data included in the packet received immediately before and therefore there is no influence of the error (packet loss).

Such a transmission method is disclosed in IETF standard RFC3267, etc. However, if two or more packets are consecutively lost, there are frames which lose coded data, and therefore it is necessary for a decoder to carry out frame loss concealing processing. An example of frame loss concealing processing is a method described in 3GPP3GTS26-091.

However, packet (or frame) loss concealing processing is carried out independently on the decoder side using coded information already received in the past, and therefore if the coding processing has been performed on the coder side using past coded information, influences of the packet loss propagate not only to the lost part but also to sections following the lost part and may drastically deteriorate the quality of decoded speech.

For example, when a CELP (Code Excited Linear Prediction) scheme is used as a speech coding scheme, speech coding/decoding processing is carried out using a past decoded/driven excitation signal, and therefore if processing on a lost frame causes different decoding excitation signals to be synthesized for the coder and decoder, the internal states of the coder and decoder may not match for a while thereafter drastically deteriorating the quality of the decoded speech.

Therefore, the conventional speech coding method has a problem that when consecutive packet losses occur, the quality of decoded speech drastically deteriorates. The above described conventional method has another problem of requiring an additional transmission delay corresponding to one frame.

SUMMARY OF THE INVENTION

It is an object of the present invention to provide a speech signal transmission system and speech signal transmission method which prevents, even after consecutive frame losses occur, influences of errors from propagating and which does not require any additional transmission delay.

In order to attain the above described object, the present invention additionally transmits coded data coded after resetting as redundant information to synchronize the internal states of the coding apparatus and decoding apparatus immediately after a frame loss, thereby prevent influences of the frame loss from propagating to normal frames after the lost frame and improve subjective quality of the decoded speech signal under a frame loss condition without any additional transmission delay. Furthermore, the present invention is designed to effectively select a frame which additionally transmits the redundant information and reduce additional transmission information wherever possible.

According to an aspect of the invention, a speech signal transmission system comprises a speech signal transmission apparatus that multiplexes and packetizes first coding information coded in a normal state and second coding information coded after resetting the internal state of a speech coding apparatus and transmits the multiplexed/packetized information to a speech signal reception apparatus, and a speech signal reception apparatus that receives the first coded information and the second coded information from the speech signal transmission apparatus, depacketizes and demultiplexes the coded information, carries out, when a packet is lost, concealment processing on the lost packet and carries out decoding processing on the packet received immediately after the lost packet using the second coded information.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENT

With reference now to the attached drawings, embodiments of the present invention will be explained in detail below.

Figure 3:
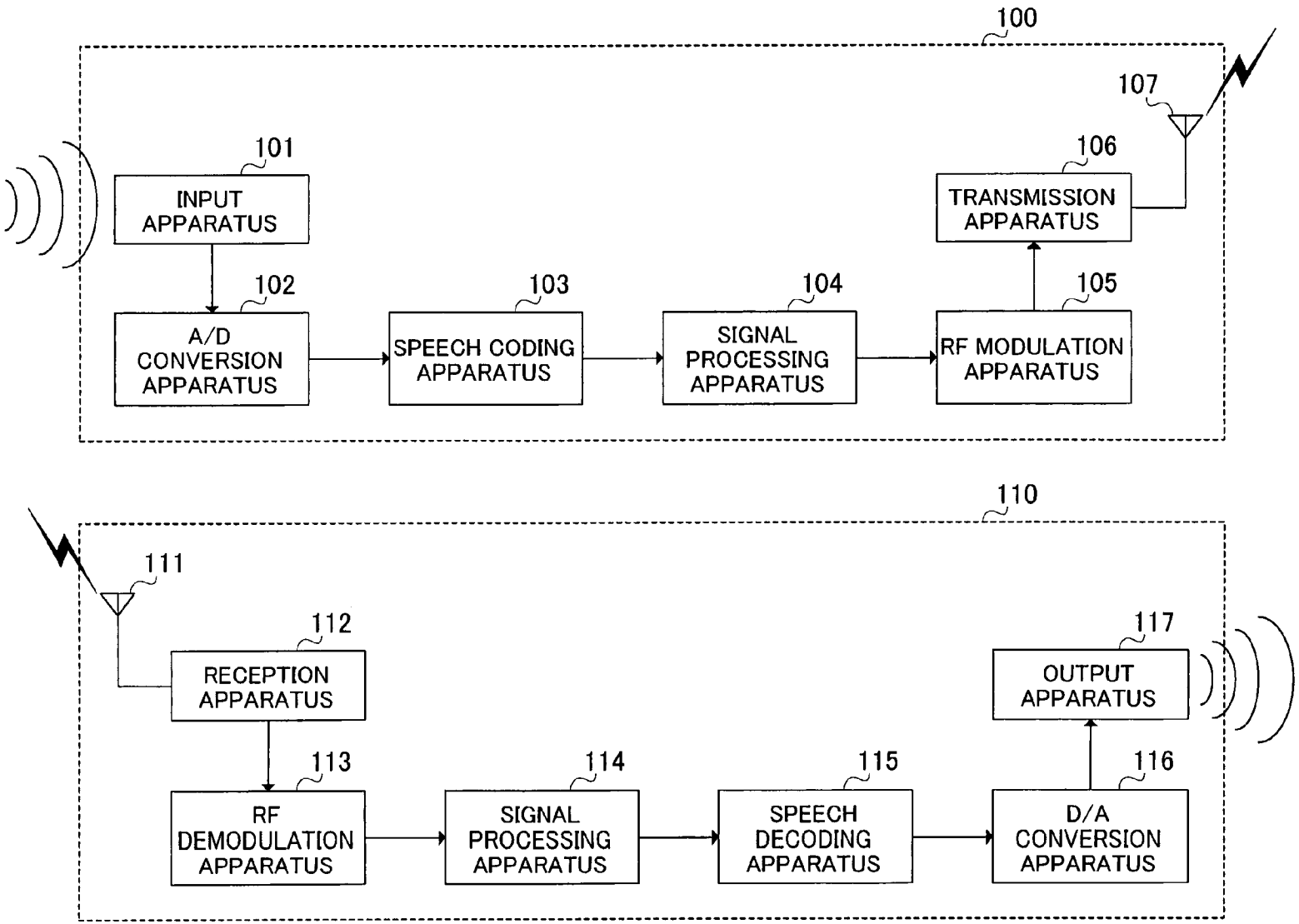
FIG. 3 is a block diagram showing configurations of a base station and a mobile station apparatus in a speech signal transmission system to which an embodiment of the present invention is applied.

FIG. 3 is a block diagram showing a configuration of a speech signal transmission system to which an embodiment of the present invention is applied.

In FIG. 3, the speech signal transmission system comprises a base station 100 provided with the function as a speech signal transmission apparatus according to the present invention and a mobile station apparatus 110 provided with the function as a speech signal reception apparatus according to the present invention.

The base station 100 is provided with an input apparatus 101, an A/D conversion apparatus 102, a speech coding apparatus 103, a signal processing apparatus 104, an RF modulation apparatus 105, a transmission apparatus 106 and an antenna 107.

An input terminal of the A/D conversion apparatus 102 is connected to the input apparatus 101. An input terminal of the speech coding apparatus 103 is connected to an output terminal of the A/D conversion apparatus 102. An input terminal of the signal processing apparatus 104 is connected to an output terminal of the speech coding apparatus 103. An input terminal of the RF modulation apparatus 105 is connected to an output terminal of the signal processing apparatus 104. An input terminal of the transmission apparatus 106 is connected to an output terminal of the RF modulation apparatus 105. The antenna 107 is connected to an output terminal of the transmission apparatus 106.

The input apparatus 101 is made up of a microphone, etc., receives the user's speech, converts this speech to an analog speech signal which is an electric signal and outputs the analog speech signal to the A/D conversion apparatus 102. The A/D conversion apparatus 102 converts the analog speech signal input from the input apparatus 101 to a digital speech signal and outputs the digital speech signal to the speech coding apparatus 103.

The speech coding apparatus 103 codes the digital speech signal input from the A/D conversion apparatus 102, generates a speech coded bit stream and outputs the speech coded bit stream to the signal processing apparatus 104. The signal processing apparatus 104 carries out channel coding processing, packetizing processing and transmission buffering processing, etc., on the speech coded bit stream input from the speech coding apparatus 103, and then outputs the speech coded bit stream to the RF modulation apparatus 105.

The RF modulation apparatus 105 modulates the signal of the speech coded bit stream subjected to the channel coding processing, etc., input from the signal processing apparatus 104 and outputs the modulated signal to the transmission apparatus 106. The transmission apparatus 106 sends the modulated speech coded signal input from the RF modulation apparatus 105 to the mobile station apparatus 110 as a radio wave (RF signal) through the antenna 107.

The base station 100 carries out processing on the digital speech signal obtained through the A/D conversion apparatus 102 in units of a frame of several tens of ms. When the network constituting the system is a packet network, coded data of one frame or several frames is put into one packet and this packet is sent to a packet network. When the network is a circuit switched network, no packetizing processing or transmission buffering processing is required.

The mobile station apparatus 110 is provided with an antenna 111, a reception apparatus 112, an RF demodulation apparatus 113, a signal processing apparatus 114, a speech decoding apparatus 115, a D/A conversion apparatus 116 and an output apparatus 117.

An input terminal of the reception apparatus 112 is connected to the antenna 111. An input terminal of the RF demodulation apparatus 113 is connected to an output terminal of the reception apparatus 112. An input terminal of the signal processing apparatus 114 is connected to an output terminal of the RF demodulation apparatus 113. An input terminal of the speech decoding apparatus 115 is connected to an output terminal of the signal processing apparatus 114. An input terminal of the D/A conversion apparatus 116 is connected to an output terminal of the speech decoding apparatus 115. An input terminal of the output apparatus 117 is connected to an output terminal of the D/A conversion apparatus 116.

The reception apparatus 112 receives a radio wave (RF signal) including speech coding information sent from the base station 100 through the antenna 111, generates a received speech coded signal which is an analog electric signal and outputs this signal to the RF demodulation apparatus 113. If the radio wave (RF signal) received through the antenna 111 has no signal attenuation or channel noise, the radio wave becomes completely the same as the radio wave (RF signal) sent from the base station 100.

The RF demodulation apparatus 113 demodulates the received speech coded signal input from the reception apparatus 112 and outputs the demodulated signal to the signal processing apparatus 114. The signal processing apparatus 114 carries out jitter absorption buffering processing, packet assembly processing and channel decoding processing, etc., on the received speech coded signal input from the RF demodulation apparatus 113 and outputs the received speech coded bit stream to the speech decoding apparatus 115.

The speech decoding apparatus 115 carries out decoding processing on the received speech coded bit stream input from the signal processing apparatus 114, generates a decoded speech signal and outputs the decoded speech signal to the D/A conversion apparatus 116. The D/A conversion apparatus 116 converts the digital decoded speech signal input from the speech decoding apparatus 115 to an analog decoded speech signal and outputs the analog decoded speech signal to the output apparatus 117. The output apparatus 117 is constructed of a speaker, etc., and converts the analog decoded speech signal input from the D/A conversion apparatus 116 to air vibration and outputs the air vibration as sound wave audible to the human ear.

Figure 4:
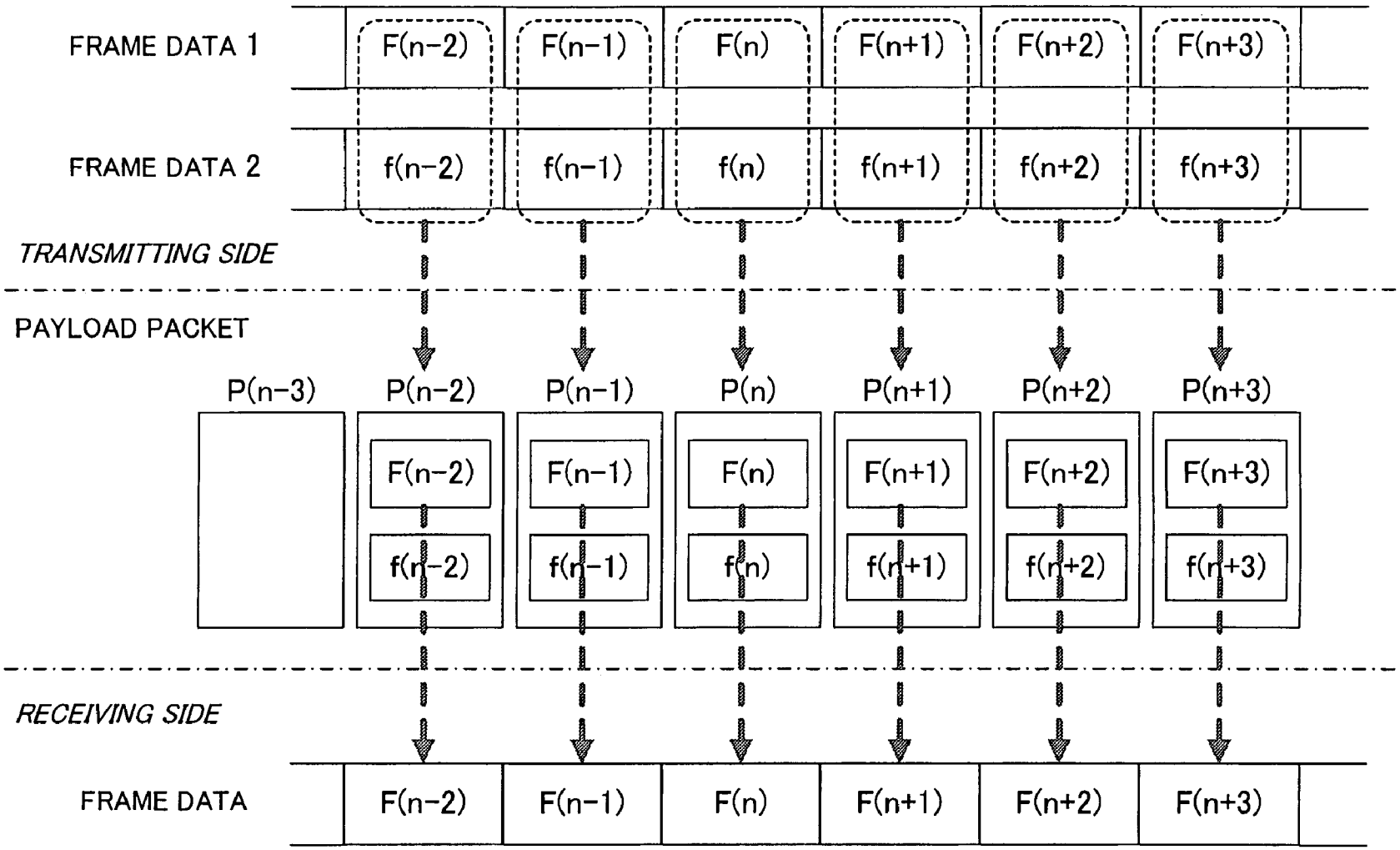
FIG. 4 illustrates a relationship between transmitted/received codes and payload packets in the speech signal transmission system according to this embodiment when there is no packet loss.

Next, a flow of coded data in the speech signal transmission system of this embodiment will be explained with reference to FIG. 4. FIG. 4 shows a case where there is no channel error.

In FIG. 4, a speech coding apparatus (not shown) performs coding on two types of frame data on the transmitting side. One is first coded information (frame data 1) that is coded in a normal state and first coded information in an nth frame is expressed as F(n) . The other is second coded information (frame data 2) that is coded after resetting the internal state of the speech coding apparatus and the second coded information at the nth frame is expressed as f(n).

As shown in FIG. 4, the first coded information F(n) and second coded information f(n) are multiplexed/packetized into one payload packet P(n) and transmitted from the transmitting side to the receiving side using a packet network. On the receiving side, the first coded information F(n) is extracted from the packet of the payload packet P(n) and handed over to a speech decoding apparatus (not shown). When there is no transmission channel error, the second coded information f(n) is not used for speech decoding processing.

Figure 5:
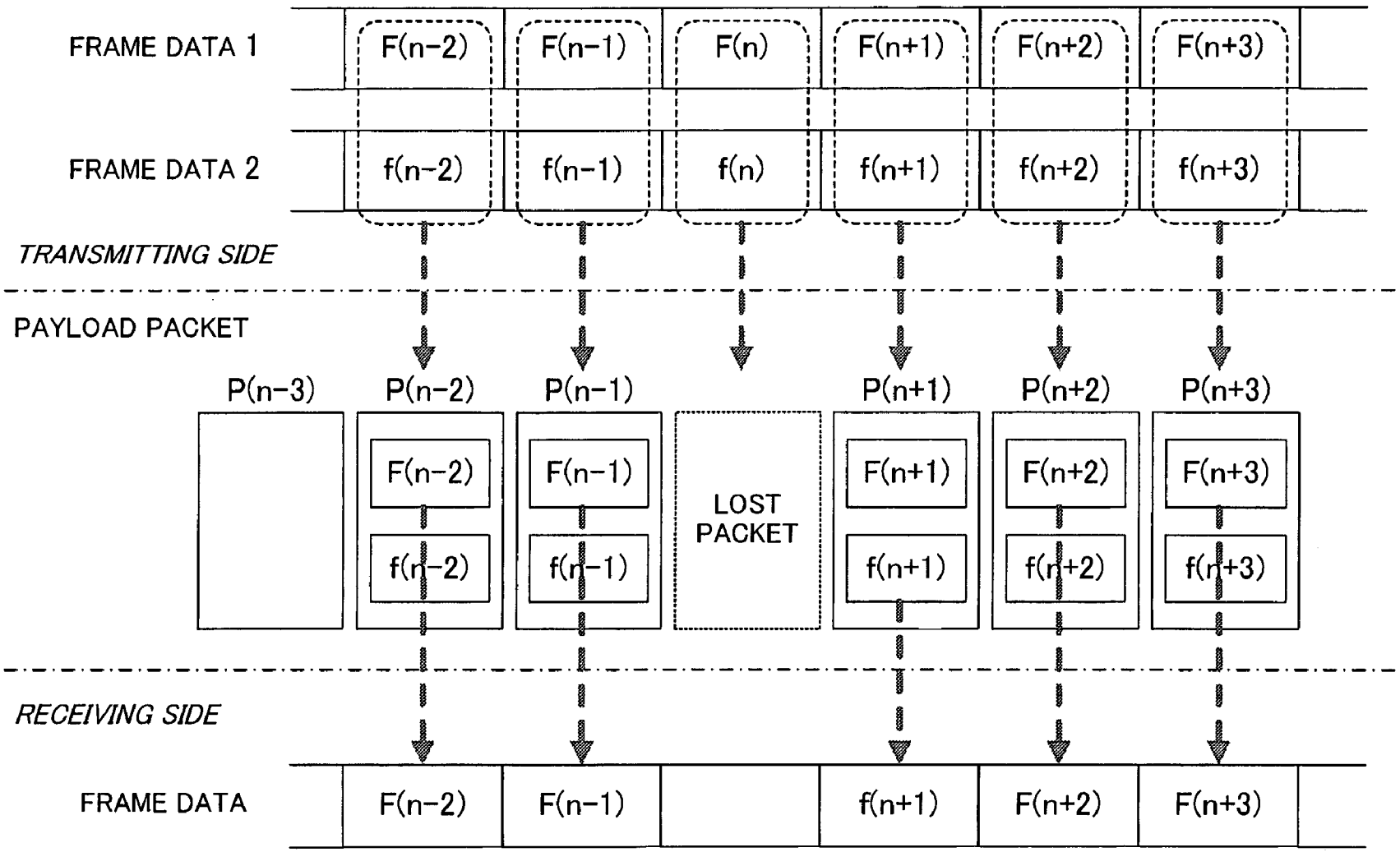
FIG. 5 illustrates a relationship between transmitted/received codes and payload packets in the speech signal transmission system according to this embodiment when the nth packet is lost.

FIG. 5 illustrates a flow of coded data in the speech signal transmission system according to this embodiment when a frame loss occurs and shows a case where the nth packet carrying the nth frame data is lost in the transmission channel;

Since the receiving side cannot receive payload packet P(n), the coded information that should be used for decoding the nth frame cannot be obtained. For this reason, the speech decoding apparatus carries out frame erasure concealment processing on the nth frame, generates a decoded speech signal and updates the internal state.

In the next (n+1)th frame, second coded information f(n+1) is extracted from a payload packet P(n+1) and handed over to the speech decoding apparatus. The speech decoding apparatus resets the internal state of a normal frame immediately after a frame loss and carries out decoding processing. In the frames from the next (n+2)th frame onward, the first coded information is extracted from the payload packet and handed over to the speech decoding apparatus.

However, as will be described later, if MA prediction is used for coding of spectral parameters or gain parameters, it is preferable to update the status of the predictor of the (n+2) th frame using first coded information F(n+1) received at the (n+1)th frame.

When such updating is not possible, for example, when the transmission rate between the apparatus that demultiplexes packet information and the speech decoding apparatus allows only one type of the coded data transmission or when input data for the speech decoding apparatus is limited to only one type, it is necessary to carry out clipping processing on the gain for a frame in which the state of the MA predictor does not match so that locally large amplitude decoded signal is avoided.

Figure 6:
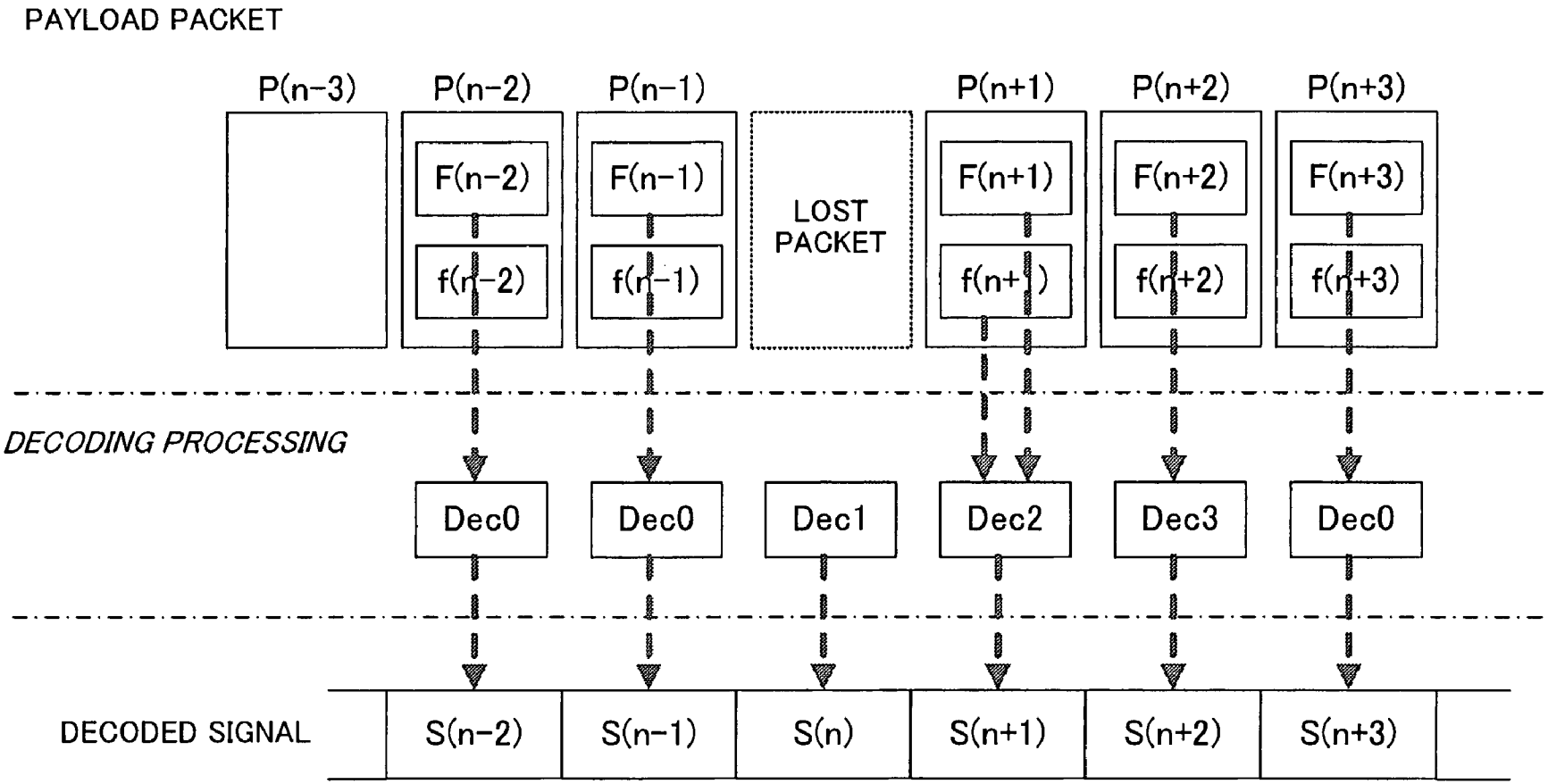
FIG. 6 illustrates a relationship between payload packets and decoding processing in the speech signal transmission system according to this embodiment when the nth packet is lost.

FIG. 6 shows a decoding processing method when the predictor is updated. The payload packet is the same as that shown in FIG. 5, and FIG. 6 shows a case where the nth packet is lost. The figure shows that how the first and second coded information, which are multiplexed inside the packet, are used to generate a decoded signal. There are four types of decoding processing (Dec0, Dec1, Dec2, Dec3) and these types are switched over according to the receiving condition of the coded information.

Dec0 is normal decoding processing and normal decoding processing is carried out using first coded information F(i) obtained by demultiplexing from payload packet P(i). Dec1 is concealment processing in the case of a frame loss and is general processing as shown in Non-Patent Document 2.

Dec2 is decoding processing carried out at a normal frame n+1 immediately after the lost frame, a decoded signal A is synthesized by carrying out the same frame loss concealment processing as for Dec1 first and then the internal state of the decoding apparatus is reset, decoding processing is carried out using second coded information f(n+1) to synthesize a decoded signal B, the decoded signals A and B are superimposed on each other and synthesized through addition processing to generate a final decoded signal. Furthermore, processing for holding the first coded information F(n+1) is carried out at the same time.

Dec3 is decoding processing carried out at the next frame n+2 after the processing of Dec2 is carried out and the internal state of the decoding apparatus is updated using the first coded information F(n+1) held by Dec2 and normal decoding processing is carried out using the first coded information F(n+2) . When the decoding apparatus uses an MA predictor, the state of the MA predictor is generated by f(n+1) at the (n+1)th frame, and therefore updating of the internal state carried out by Dec3 refers to processing whereby the state of the MA predictor is regenerated by F(n+1) at the (n+2)th frame so that the decoding processing at the (n+2)th frame is carried out correctly. When the order of MA prediction is high and the state of the MA predictor is generated from coded information of two or more frames, it is necessary to continue the decoding processing of Dec3 for two or more frames, but FIG. 6 assumes that the state of the MA predictor is generated within one frame.

Next, a block diagram of the speech decoding apparatus for realizing decoding processing by Dec0, 1, 2, 3 are shown in FIG. 7 to FIG. 11 and the configuration and operation thereof will be explained.

Figure 7:
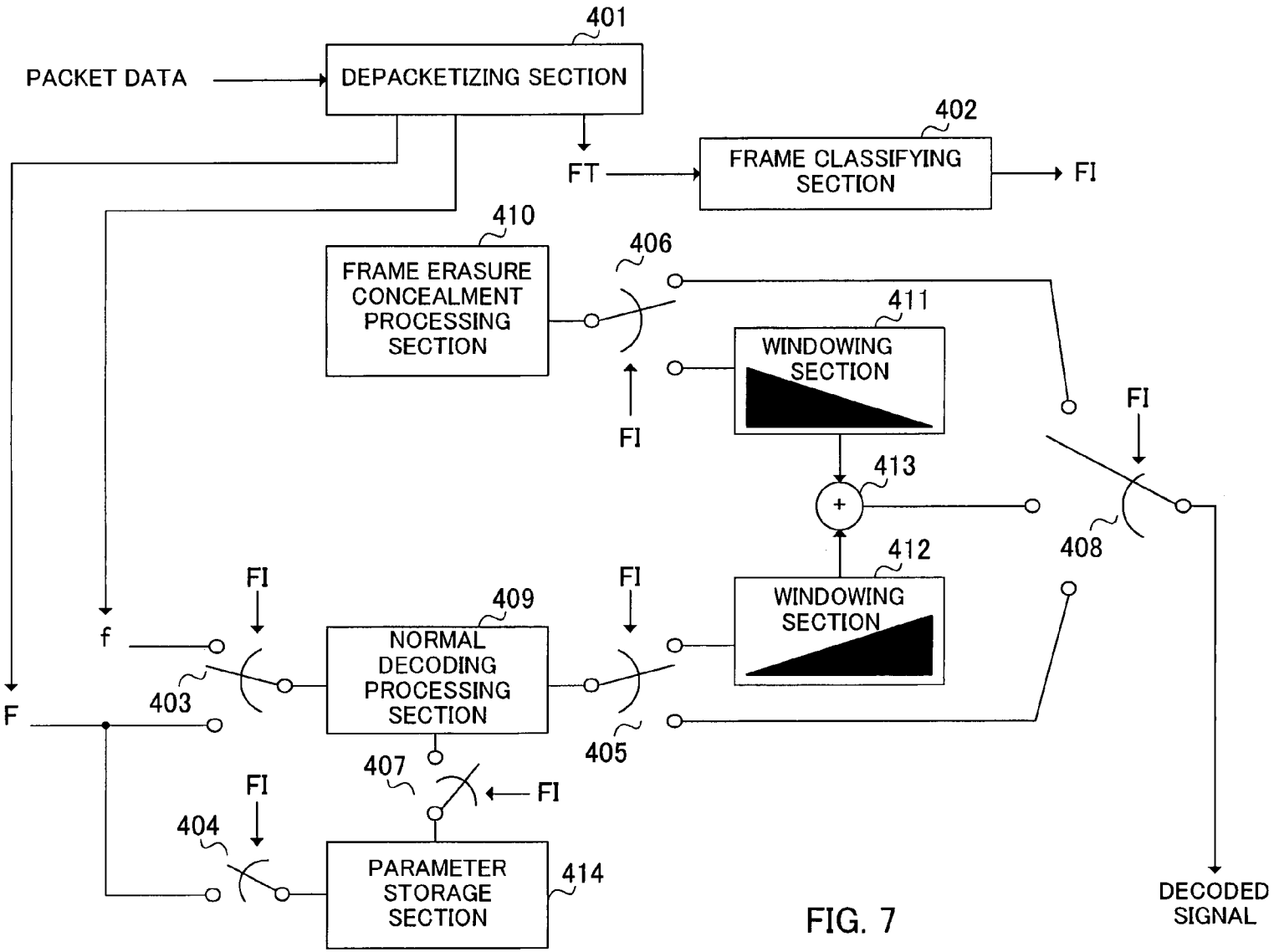
FIG. 7 is a block diagram of a speech decoding apparatus used in the speech signal transmission system according to this embodiment.

FIG. 7 is a block diagram illustrating the configuration of the speech decoding apparatus. The speech decoding apparatus comprises a depacketizing section 401, a frame classifying section 402, changeover switches 403, 404, 405, 406, 407, 408, a normal decoding processing section 409, a frame erasure concealment processing section 410, windowing sections 411, 412, an adder 413 and a parameter storage section 414.

The depacketizing section 401 extracts first coded information F, second coded information f and frame type information FT from a packet payload (packet data), outputs the first coded information F and second coded information f to the changeover switches 403, 404 and outputs the frame type information FT to the frame classifying section 402.

The frame classifying section 402 decides which processing of the decoding processing Dec0 to Dec3 should be performed based on the frame type information FT input from the depacketizing section 401, generates frame class information FI indicating decoding processing Dec0 to Dec3 as the decision result and outputs the frame class information FI to the changeover switches 403 to 408.

The changeover switches 403 to 408 are changed over to changeover positions according to the decoding processing Dec0 to Dec3 based on the frame class information FI input from the frame classifying section 402.

The normal decoding processing section 409 resets the internal state of the decoding apparatus first and then carries out decoding processing on the second coded information f input from the depacketizing section 401 through the changeover switch 403, generates a second decoded signal $S_o(n)$ and outputs the signal to the windowing section 412 through the changeover switch 405.

The frame erasure concealment processing section 410 generates a first decoded signal Sf(n) (n is sample number)

and outputs the first decoded signal to the windowing section 411 through the changeover switch 406.

The windowing section 411 multiplies the first decoded signal Sf(n) input from the frame erasure concealment processing section 410 by a window whose amplitude attenuates with time (e.g., a triangular window expressed by wf(n)=1−n/L, where L is the window length) and outputs the multiplication result to the adder 413.

The windowing section 412 multiplies the second decoded signal $S_o(n)$ input from the normal decoding processing section 409 by a window whose amplitude increases with time (e.g., a triangular window expressed by $w_o(n)=n/L$) and outputs the multiplication result to the adder 413.

The adder 413 adds up the two signals input from the windowing sections 411 and 412 and outputs the addition result as a final decoded signal through the changeover switch 408.

The parameter storage section 414 incorporates a memory and stores the first coded information F input from the depacketizing section 401 in the memory through the changeover switch 404.

Note that the changeover statuses of the changeover switches 403 to 408 shown in FIG. 7 do not correspond to the decoding processing Dec0 to Dec3. The changeover statuses of the changeover switches 403 to 408 corresponding to the decoding processing Dec0 to Dec3 are shown in FIG. 8 to FIG. 11.

Figure 8:
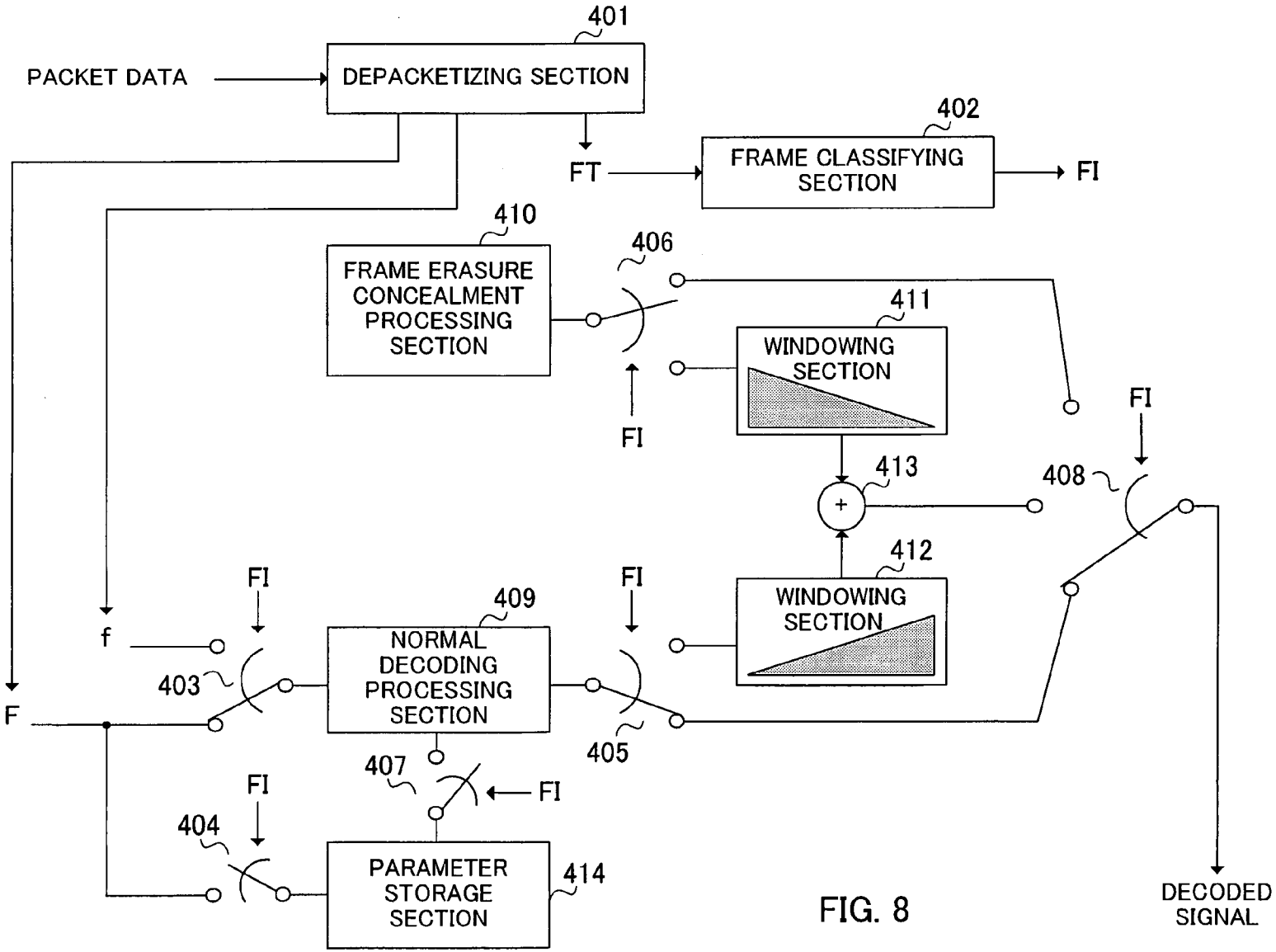
FIG. 8 is a block diagram when Dec0 is processed by a speech decoding apparatus used for a speech signal transmission system according to this embodiment.

FIG. 8 shows the operations of the changeover switches 403 to 408 when performing decoding processing by Dec0 and shows the parts not used for decoding processing by Dec0 (windowing sections 411, 412) light-colored in FIG. 7.

The depacketizing section 401 extracts first coded information F, second coded information f and frame type information FT from a packet payload (packet data). The frame type information FT indicates information on the coding apparatus which has generated coded information (which identifies the algorithm or bit rate, etc.) or information that a packet loss has occurred and is multiplexed into a payload packet as information different from coded information. The frame type information FT is input to the frame classifying section 402 and the frame classifying section 402 decides which processing of the decoding processing Dec0 to Dec3 should be performed according to the frame type information FT, generates frame class information FI indicating decoding processing Dec0 to Dec3 as the decision result and outputs the frame class information FI to the changeover switches 403 to 408.

Next, in FIG. 8, the frame class information FI shows that processing by Dec0 is carried out, and therefore the changeover switch 403 connected to the input terminal of the normal decoding processing section 409 is connected to the output terminal of the first coded information F of the depacketizing section 401, the changeover switch 405 connected to the output terminal of the normal decoding processing section 409 is connected to the changeover switch 408 and the changeover switch 408 connected to the final output terminal is connected to the changeover switch 405 and the changeover switches 404, 407 are opened. The first coded information F output from the depacketizing section 401 is decoded by the normal decoding processing section 409 and the decoded signal is output as the final decoded signal.

Figure 9:
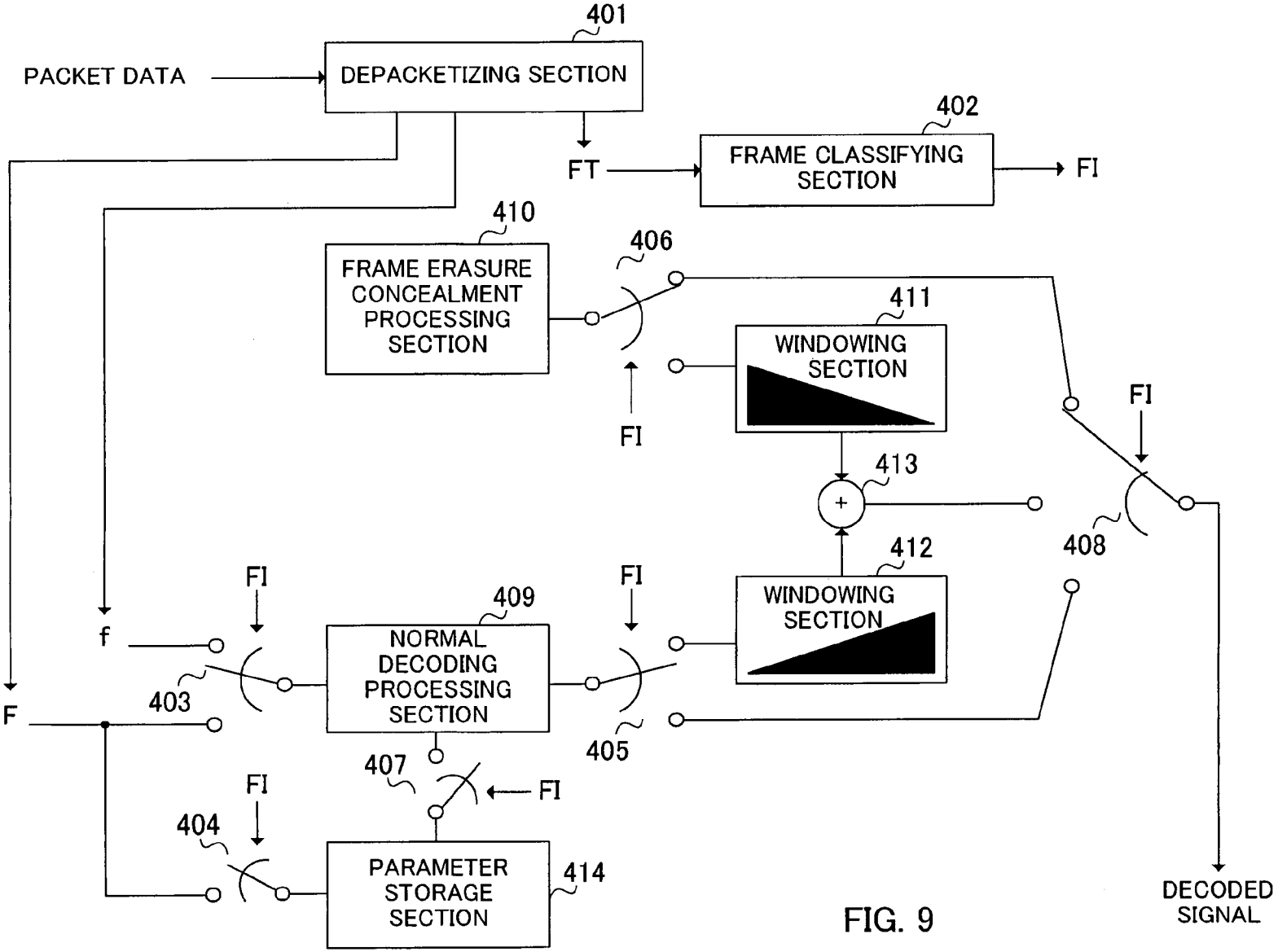
FIG. 9 is a block diagram when Dec1 is processed by the speech decoding apparatus used for a speech signal transmission system according to this embodiment.

Next, in FIG. 9, the frame class information FI shows that processing by Dec1 is carried out, and therefore the changeover switch 406 connected to the output terminal of the frame erasure concealment processing section 410 is connected to the changeover switch 408 and the changeover switch 408 connected to the final output terminal is connected to the changeover switch 406 and the changeover switches 404, 407 are opened. The decoded signal generated by the frame erasure concealment processing section 410 is output as the final decoded signal.

Figure 10:
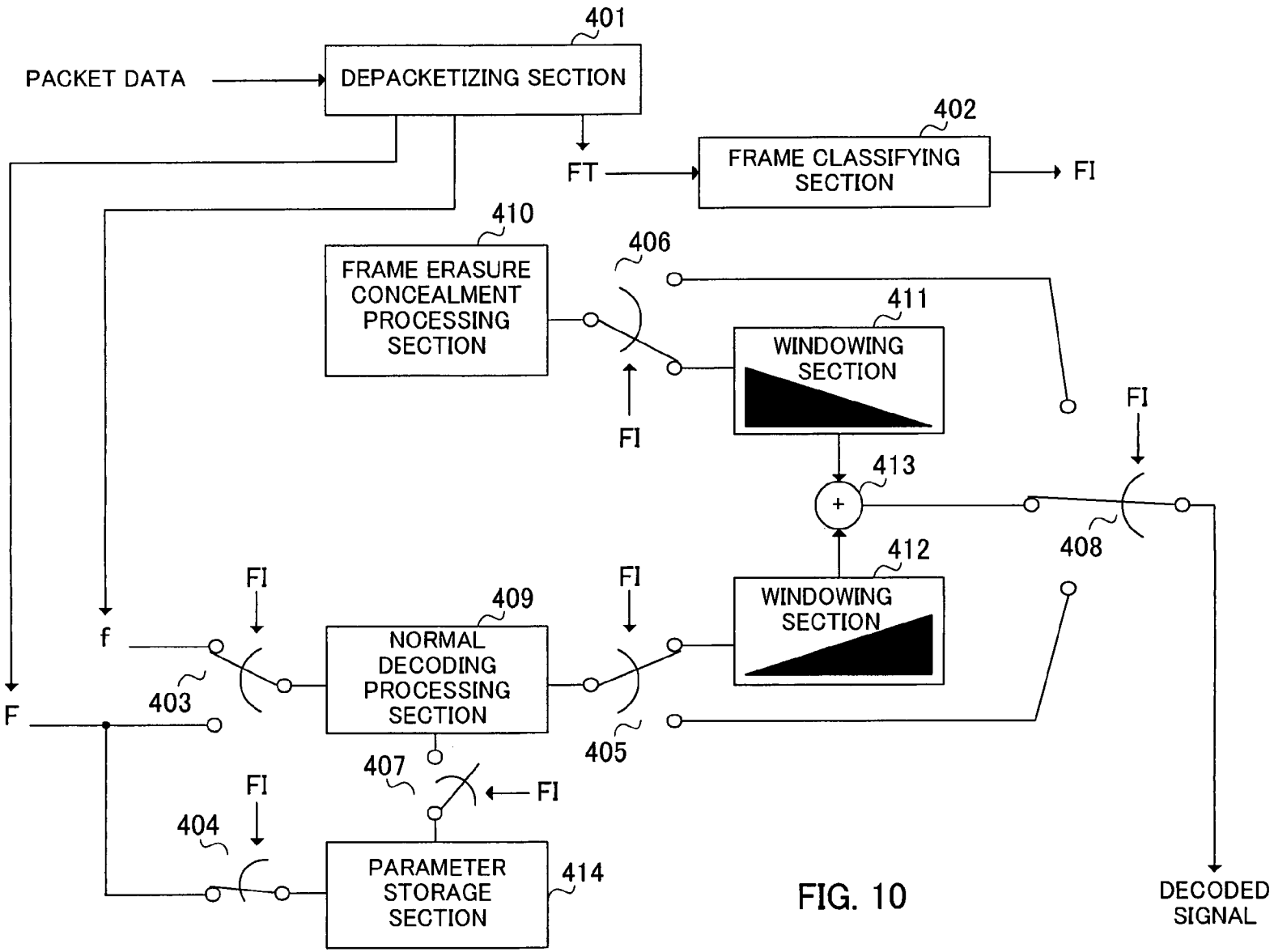
FIG. 10 is a block diagram when Dec2 is processed by the speech decoding apparatus used for a speech signal transmission system according to this embodiment.

Next, in FIG. 10, the frame class information FI indicates that processing by Dec2 is carried out, and therefore the changeover switch 406 connected to the output terminal of the frame erasure concealment processing section 410 is connected to the windowing section 411, the changeover switch 403 connected to the input terminal of the normal decoding processing section 409 is connected to the output terminal of the second coded information f of the depacketizing section 401, the changeover switch 405 connected to the output terminal of the normal decoding processing section 409 is connected to the windowing section 412, the changeover switch 404 connected to the input terminal of the parameter storage section 414 is closed and the changeover switch 407 connected to the output terminal of the parameter storage section 414 is opened.

In the case of FIG. 10, the processing procedure will be a flow as shown below:

First, the frame erasure concealment processing section 410 generates a first decoded signal Sf. Next, the internal state of the normal decoding processing section 409 is reset and the parameter storage section 414 stores the first coded information F. Next, the normal decoding processing section 409 generates a second decoded signal So using the second coded information f. Next, the windowing sections 411, 412 and the adder 413 carry out superimposed addition processing as shown in Expression (1) and generate a final output signal S.

$$S(n)=wf(n)Sf(n)+wo(n)So(n) \quad (1)$$

Figure 11:
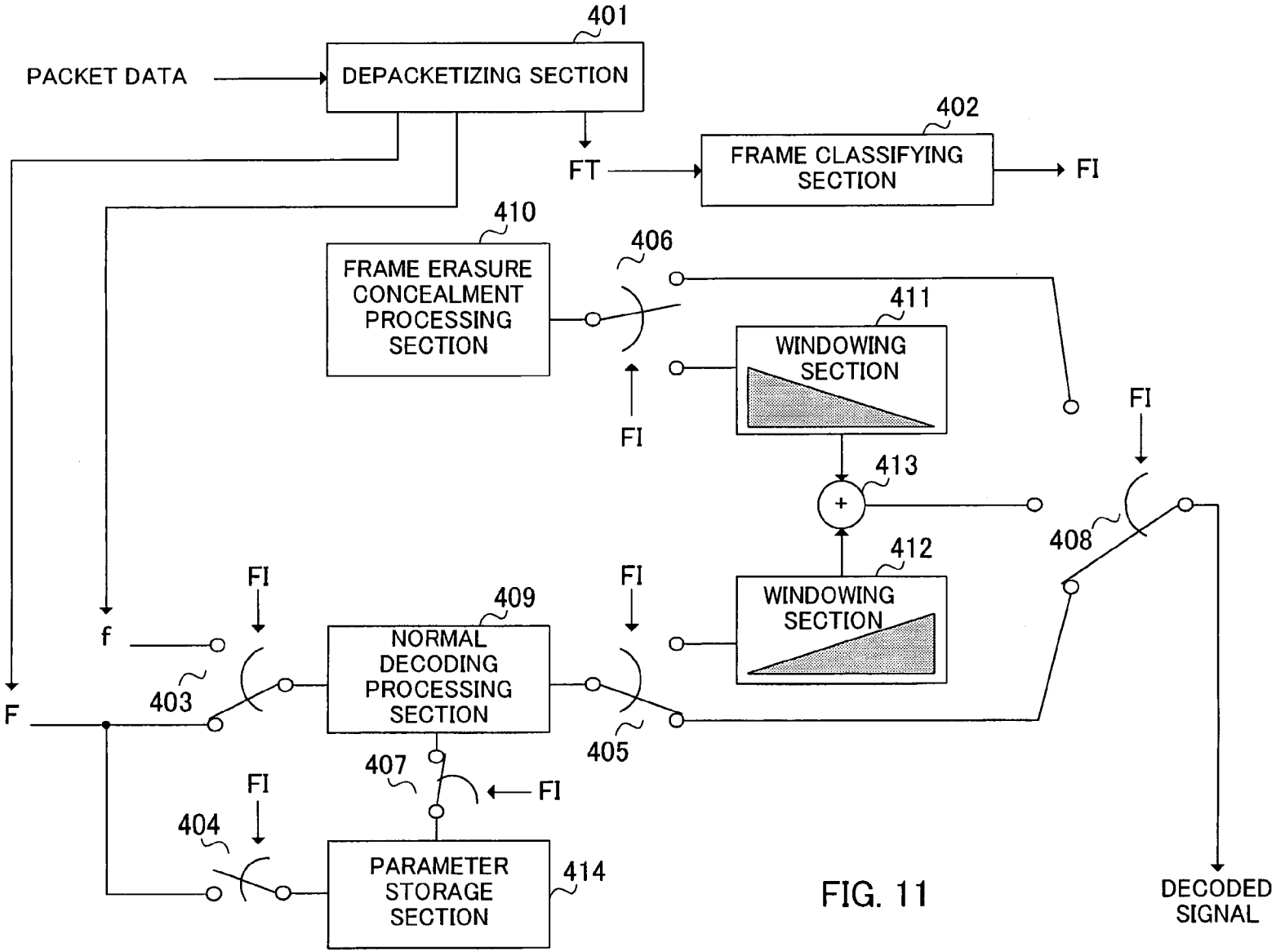
FIG. 11 is a block diagram when Dec3 is processed by the speech decoding apparatus used for a speech signal transmission system according to this embodiment.

Next, in FIG. 11, since the frame class information FI indicates that processing by Dec3 is carried out, the changeover switch 403 connected to the input terminal of the normal decoding processing section 409 is connected to the output terminal of the first coded information F of the depacketizing section 401, the changeover switch 407 connected to the output terminal of the parameter storage section 414 is connected to another input terminal of the normal decoding processing section 409, the changeover switch 405 connected to the output terminal of the normal decoding processing section 409 is connected to the changeover switch 408 and the changeover switch 408 connected to the final output terminal is connected to the changeover switch 405.

The parts not used for decoding processing by Dec3 in FIG. 11 (windowing sections 411, 412) are expressed with light-colored.

In this case, the normal decoding processing section 409 updates at least part of the internal state of the decoding apparatus using first coded information F(n+1) of the immediately preceding frame input from the parameter storage section 414 through the changeover switch 407, carries out decoding processing on the first coded information F(n+2) input from the depacketizing section 401 through the changeover switch 403 and outputs the decoded signal through the changeover switches 405, 408 as a final decoded signal.

In FIG. 11, the processing procedure will be a flow as shown below:

First, the normal decoding processing section 409 regenerates part of the internal state of the decoding apparatus using the first coded information F(n+1) of the immediately preceding frame stored in the memory of the parameter storage section 414. Next, normal speech decoding processing is carried out using the first coded information F(n+2) of the current frame and the decoded signal is designated as the final output.

Next, the internal configuration of the speech coding apparatus 103 in the base station 100 will be explained with reference to the block diagram shown in FIG. 12.

Figure 12:
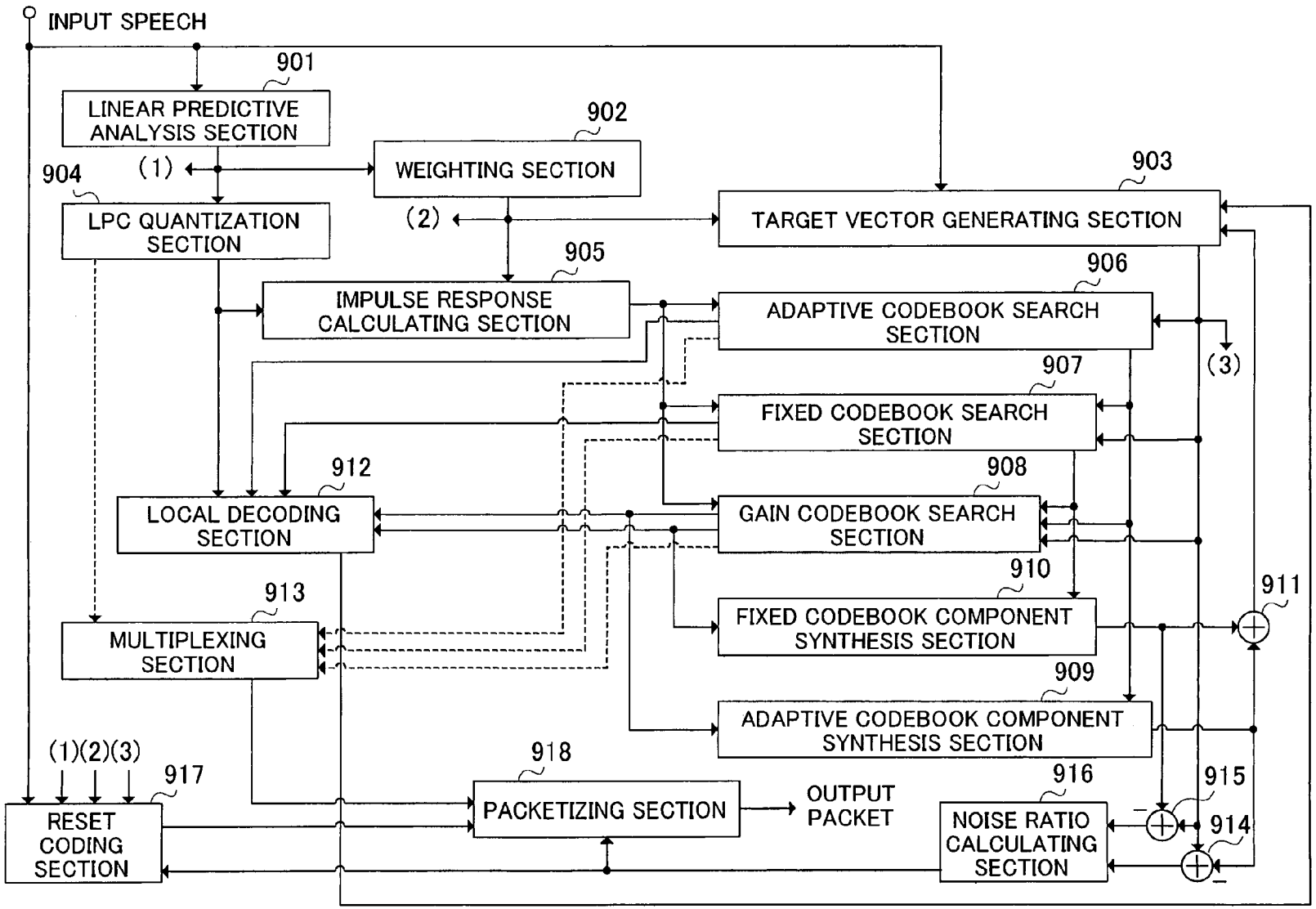
FIG. 12 is a block diagram of a speech coding apparatus used in a speech signal transmission system according to this embodiment.

In FIG. 12, reference numeral 901 denotes a linear predictive analysis section that carries out a linear predictive analysis on an input speech signal, 902 denotes a weighting section that carries out perceptual weighting, 903 denotes a target vector generation section that generates a target signal synthesized according to a CELP model, 904 denotes an LPC quantization section that quantizes a set of linear predictive coefficients, 905 denotes an impulse response calculation section that calculates an impulse response of a cascaded filter of a synthesis filter made up of a quantized linear predictive coefficient and a filter which carries out perceptual weighting, 906 denotes an adaptive codebook search section, 907 denotes a fixed codebook search section, 908 denotes a gain codebook search section, 909 denotes an adaptive codebook component synthesis section that calculates a signal generated from only the adaptive codebook, 910 denotes a fixed codebook component synthesis section that calculates a signal generated from only the fixed codebook, 911 denotes an adder that adds up the adaptive codebook component and the fixed codebook component, 912 denotes a local decoding section that generates a decoded speech signal using quantized parameters, 913 denotes a multiplexing section that multiplexes coded parameters, 914 denotes an adder that calculates an error between an adaptive codebook component and a target signal, 915 denotes an adder that calculates an error between the fixed codebook component and a target signal, 916 denotes a noise ratio calculating section that calculates the ratio of error signals calculated by the adders 914 and 915, 917 denotes a reset coding section that carries out processing of respective sections 904 to 913 with the encoder state (e.g., contents of the adaptive codebook, a predictor state of the LPC quantizer, a predictor state of the gain quantizer, etc.) reset, 918 denotes a packetizing section that packetizes a bit stream coded in a normal state and a bit stream coded after the state reset.

An input speech signal to be coded is input to the linear predictive analysis section 901, the target vector generation section 903 and the reset coding section 917. The linear predictive analysis section 901 carries out a linear predictive analysis and outputs a set of linear predictive coefficients to the weighting section 902, the LPC quantizing section 904 and the reset coding section 917.

The weighting section 902 calculates a perceptual weighting filter coefficients and outputs the perceptual weighting filter coefficients to the target vector generating section 903, the impulse response calculating section 905 and the reset coding section 917. The perceptual weighting filter is a pole-zero filter as expressed by a transfer function shown in Expression (2) below.

In this Expression (2), P denotes the order of linear predictive analysis, $a_i$ denotes $_i$th order linear predictive coefficient. $\gamma_1$ and $\gamma_2$ denote weighting factors, which may be constants or may be adaptively controlled according to the features of an input speech signal. The weighting section 902 calculates $\gamma_1^i \times a_i$ and $\gamma_2^i \times a_i$.

$$W(z) = \frac{A(z/\gamma_1)}{A(z/\gamma_2)} = \frac{1 + \sum_{i=1}^{P} \gamma_1^i a_i z^{-1}}{1 + \sum_{i=1}^{P} \gamma_2^i a_i z^{-1}} \tag{2}$$

The target vector generating section 903 calculates a signal obtained by subtracting a zero-input response of the synthesis filter (constructed of a set of quantized linear predictive coefficients) filtered by the perceptual weighting filter from the input speech signal filtered by the perceptual weighting filter in Expression (2) and outputs the subtraction result to the adaptive codebook search section 906, the fixed codebook search section 907, the gain codebook search section 908, the adder 914, the adder 915 and the reset coding section 917.

The target vector can be obtained using a method of subtracting a zero-input response as described above, but the target vector is generally generated in the following manner. First, the input speech signal is filtered by an inverse filter A(z) to obtain a linear predictive residual. Next, this linear predictive residual is filtered by a synthesis filter 1/A' (z) made up of a set of quantized linear predictive coefficients. However, the filter state at this time is a signal obtained by subtracting a synthesized speech signal (generated by the local decoding section 912) from the input speech signal. In this way, an input speech signal after removing the zero-input response of the synthesis filter 1/A' (z) is obtained.

Next, this input speech signal after removing the zero-input response is filtered by the perceptual weighting filter W(z). However, the filter state (AR part) at this time is a signal obtained by subtracting the weighted synthesized speech signal from the weighted input speech signal. Here, this signal (signal obtained by subtracting the weighted synthesized speech signal from the weighted input speech signal) is equivalent to a signal obtained by subtracting the sum of the product of the adaptive codebook component (signal generated by filtering the adaptive code vector by the zero-state synthesis filter 1/A' (z) and perceptual weighting filter W(z)) by a quantized gain and the product of the fixed codebook component (signal generated by filtering the fixed code vector by the zero-state synthesis filter 1/A' (z) and perceptual weighting filter W(z)) by a quantized gain from the target vector, and therefore the signal is generally calculated in such a way (as written in Expression (3). In Expression (3), x denotes a target vector, $g_a$ denotes an adaptive codebook gain, H denotes a weighting synthesis filter impulse response convolution matrix, y denotes an adaptive code vector, $g_f$ denotes a fixed codebook gain, z denotes a fixed code vector, respectively).

$$x-(g_a Hy+g_f Hz) \tag{3}$$

The LPC quantization section 904 carries out quantization and coding on the linear predictive coefficients (LPC) input from the linear predictive analysis section 901 and outputs the quantized LPC to the impulse response calculating section 905 and the local decoding section 912 and outputs the coded information to the multiplexing section 913. LPC is generally converted to LSP, etc., and then quantization and coding on the LSP are performed.

The impulse response calculating section 905 calculates an impulse response of a cascaded filter of the synthesis filter 1/A' (z) and the perceptual weighting filter W(z) and outputs the impulse response to the adaptive codebook search section 906, the fixed codebook search section 907 and the gain codebook search section 908.

The adaptive codebook search section 906 receives the impulse response of the perceptual weighted synthesis filter from the impulse response calculating section 905, the target vector from the target vector generating section 903, carries out an adaptive codebook search and outputs an adaptive code vector to the local decoding section 912, an index corresponding to the pitch lag to the multiplexing section 913, and a signal with the impulse response (input from the impulse response calculation section 905) convoluted into the adaptive code vector to the fixed codebook searching section 907, the gain codebook searching section 908 and the adaptive codebook component synthesis section 909, respectively.

An adaptive codebook search is carried out by determining an adaptive code vector y which minimizes a square error between the target vector and the signal synthesized from the adaptive code vector (Expression (4)).

$$\|x-g_a Hy\|^2 \tag{4}$$

The fixed codebook search section 907 receives the impulse response of the perceptual weighted synthesis filter from the impulse response calculating section 905, the target vector from the target vector generating section 903, a vector with a perceptual weighted synthesis filter impulse response convoluted into the adaptive code vector from the adaptive codebook search section 906, respectively, performs a fixed codebook search, and outputs a fixed code vector to the local decoding section 912, a fixed codebook index to the multiplexing section 913, a signal with the impulse response (input from the impulse response calculating section 905) convoluted into the fixed code vector to the gain codebook search section 908 and the fixed codebook component synthesis section 910, respectively.

A fixed codebook search refers to finding a fixed code vector z which minimizes the energy (sum of squares) in Expression (3). It is a general practice to use a target signal x' for the fixed codebook search. The target signal x' is calculated by subtracting the already determined adaptive code vector y multiplied by an optimum adaptive codebook gain (pitch gain) $g_a$ (quantized adaptive codebook gain is used instead of the optimum adaptive codebook gain when gain quantization is carried out before a fixed codebook search) and convoluted with the impulse response from the target vector x in the adaptive codebook search (that is, $x-g_a Hy$) . A fixed code vector z is determined by minimizing the term of $|x'-g_2 Hz|^2$.

The gain codebook searching section 908 receives the impulse response of the perceptual weighting synthesis filter from the impulse response calculating section 905, the target vector from the target vector generating section 903, a vector with the impulse response of the perceptual weighting synthesis filter convoluted into the adaptive code vector from the adaptive codebook search section 906, a vector with the impulse response of the perceptual weighting synthesis filter convoluted into the fixed code vector from the fixed codebook search section 907, respectively, carries out a gain codebook search, and outputs the quantized adaptive codebook gain to the adaptive codebook component synthesis section 909 and the local decoding section 912, the quantized fixed codebook gain to the fixed codebook component synthesis section 910 and the local decoding section 912 and the gain codebook index to the multiplexing section 913, respectively. A gain codebook search refers to selecting a code for generating a quantized adaptive codebook gain ($g_a$) and quantized fixed codebook gain ($g_f$) which minimizes the energy (sum of squares) in Expression (3) from the gain codebook.

The adaptive codebook component synthesis section 909 receives the vector with the impulse response of the perceptual weighting synthesis filter convoluted into the adaptive code vector from the adaptive codebook search section 906 and the quantized adaptive codebook gain from the gain codebook search section 908, respectively, multiplies the one by the other and outputs the product as the adaptive codebook component of the perceptual weighting synthesized signal to the adder 911 and the adder 914.

The fixed codebook component synthesis section 910 receives the vector with the impulse response of the perceptual weighting synthesis filter convoluted into the fixed code vector from the fixed codebook search section 907 and the quantized fixed codebook gain from the gain codebook search section 908, respectively, multiplies the one by the other and outputs the product as the fixed codebook component of the perceptual weighting synthesized signal to the adder 911 and the adder 915.

The adder 911 receives the adaptive codebook component of the perceptual weighting synthesized speech signal from the adaptive codebook component synthesis section 909 and the fixed codebook component of the perceptual weighting synthesized speech signal from the fixed codebook component synthesis section 910, respectively, adds up the two and outputs the addition result as the perceptual weighted synthesized speech signal (zero-input response is removed) to the target vector generation section 903. The perceptual weighting synthesized speech signal input to the target vector generation section 903 is used to generate a filter state of the perceptual weighting filter when the next target vector is generated.

The local decoding section 912 receives the quantized linear predictive coefficients from the LPC quantization section 904, the adaptive code vector from the adaptive codebook search section 906, the fixed code vector from the fixed codebook search section 907, the adaptive codebook gain and fixed codebook gain from the gain codebook search section 908, respectively, drives the synthesis filter made up of the quantized linear predictive coefficients using an excitation vector obtained by adding up the product of the adaptive code vector by the adaptive codebook gain and the product of the fixed code vector by the fixed codebook gain, generates a synthesized speech signal and outputs the synthesized speech signal to the target vector generation section 903. The synthesized speech signal input to the target vector generating section 903 is used to generate a filter state for generating a synthesized speech signal after a zero-input response is removed when the next target vector is generated.

The multiplexing section 913 receives the coded information of the quantized LPC from the LPC quantization section 904, the adaptive codebook index (pitch lag code) from the adaptive codebook search section 906, the fixed codebook index from the fixed codebook search section 907, the gain codebook index from the gain codebook search section 908, respectively, multiplexes them into one bit stream and outputs the bit stream to the packetizing section 918.

The adder 914 receives the adaptive codebook component of the perceptual weighting synthesized speech signal from the adaptive codebook component synthesis section 909 and the target vector from the target vector generating section 903, respectively, calculates energy of the difference signal between the two and outputs the energy value to the noise ratio calculation section 916.

The adder 915 receives the fixed codebook component of the perceptual weighting synthesized speech signal from the fixed codebook component synthesis section 910 and the target vector from the target vector generation section 903, calculates energy (sum of squares) of the difference signal between the two and outputs the energy value to the noise ratio calculation section 916.

The noise ratio calculation section 916 calculates the ratio of energy input from the adder 914 and adder 915 and sends a control signal to the reset coding section 917 and packetizing section 918 based on whether the ratio exceeds a preset threshold or not. That is, control is performed so that coding processing by the reset coding section 917 is carried out only when the ratio exceeds the threshold and the coded bit stream obtained is packetized. The ratio is calculated, for example, from the following Expression (5). Here, Na denotes the energy value input from the adder 914 and Nf denotes the energy value input from the adder 915.

$$10 \log_{10} \frac{Nf}{Na} \tag{5}$$

Expression (5) corresponds to a difference between the S/N ratio of the adaptive codebook component to the target vector, and the S/N ratio of the fixed codebook component to the target vector. As the threshold, for example, in the case of a 12.2 kbit/s in an AMR scheme which is a 3GPP standard scheme, approximately 3 [dB] is appropriate.

Furthermore, since it is when a frame loss occurs at the onset part of speech that the subjective quality is drastically improved by transmitting the coded data of the reset coding section 917, it is efficient to selectively operate the reset coding section 917 only at a frame in the vicinity of the onset part. More specifically, the ratio of the average amplitude of the preceding frame to the average amplitude of the current frame is calculated and the case where the amplitude of the current frame exceeds ThA (threshold: e.g., 2.0) times the average amplitude of the preceding frame is defined as an onset (rising) frame, the frame at which the reset coding section 917 is operated is limited to only two types of frames (1), (2), and it is possible to thereby realize much more effective and efficient speech signal transmission system (this configuration can be realized though not shown in FIG. 12, by calculating the root means square (RMS) of the target vector output from the target vector generating section 903, calculating the ratio of the calculation result at the current frame to the calculation result at the preceding frame, and add a functional block which decides the onset frame based on whether the value exceeds the threshold ThA or not (frame in (1) below). For the decision of the frame in (2) below, it is possible to provide a dedicated frame counter which is always reset at the frame in (1) below. It is also possible to use frame energy instead of the average amplitude, and in that case it is possible to simply calculate the sum of squares of one frame signal without calculating the root means square (RMS)

(1) The onset frame (2) Frames, the result of Expression (5) of which exceeds a threshold in the noise ratio calculation section 916, and a few frames immediately after the onset frame (approximately 1 to 3 frames)

Making such a selection makes it possible to realize subjective quality substantially equivalent to that when coded information of the reset coding section 917 is transmitted at all frames without transmitting coded information of the reset coding section 917 at 80% or more of all frames.

The reset coding section 917 receives the input speech signal, the linear predictive coefficients from the linear predictive analysis section 901, the weighted linear predictive coefficients from the weighting section 902, the target vector from the target vector generating section 903, the control signal from the noise ratio calculation section 916, respectively and when the control signal indicates that coding is performed by the reset coder 917, the reset coding section 917 carries out completely the same processing as that in 904 to 913 with the internal state reset (zero-clear of the adaptive codebook buffer, zero-clear of the state of the synthesis filter, zero-clear of the state of the perceptual weighting filter, initialization of the LSP predictor, initialization of the fixed codebook gain predictor, etc.) and outputs the coded bit stream to the packetizing section 918.

The packetizing section 918 receives the normal coded bit stream from the multiplexing section 913 and the coded bit stream coded after reset from the reset coding section 917, packs the bit streams in the payload packet and outputs to the packet transmission channel.

Next, the operation of the speech decoding apparatus 115 which has received the packet data coded by the speech coding apparatus 103 is the same as that explained in FIG. 7 to FIG. 11 except the following points:

In a configuration aspect, the speech decoding apparatus 115 further comprises a reset code detecting section (not shown) which checks whether the reception packet includes a code f or not. The reset code detecting section receives header information of the packet from the depacketizing section 401, checks to see whether the reset code f is included in the packet or not and outputs the result information M of the check result to the frame classifying section 402.

In an operation aspect, the processing by Dec2 is divided into two categories; one is the same processing as that by Dec2 which has been already explained and the other is the same processing as that by Dec0 which has been already explained. That is, when the result information M indicates that "the code f is included in the packet", the same processing as that by Dec2 (FIG. 10) is carried out and when the result information M indicates that "the code f is not included in the packet", the same processing as that by Dec0 is carried out (FIG. 8).

When the same processing as that by Dec0 is carried out, the propagation of errors generated by the frame erasure concealment processing performed on the immediately preceding frame can be reset by setting the adaptive codebook gain to 0 and generating a synthesis signal in the normal decoding processing section 409. Furthermore, when the above described processing by Dec0 is carried out at a normal frame immediately after a frame loss, the processing by Dec0 instead of the processing by Dec3 is carried out at the subsequent frames.

As explained above, according to the present invention, not only normally coded information but also information coded after resetting the internal state of the coding apparatus is transmitted, and therefore it is possible to drastically reduce quality degradation of the decoded speech signal due to error propagation at the correctly received frame after a frame loss. The present invention has the same improvement effect even after consecutive frame losses and requires no additional delay.

Figure 1:
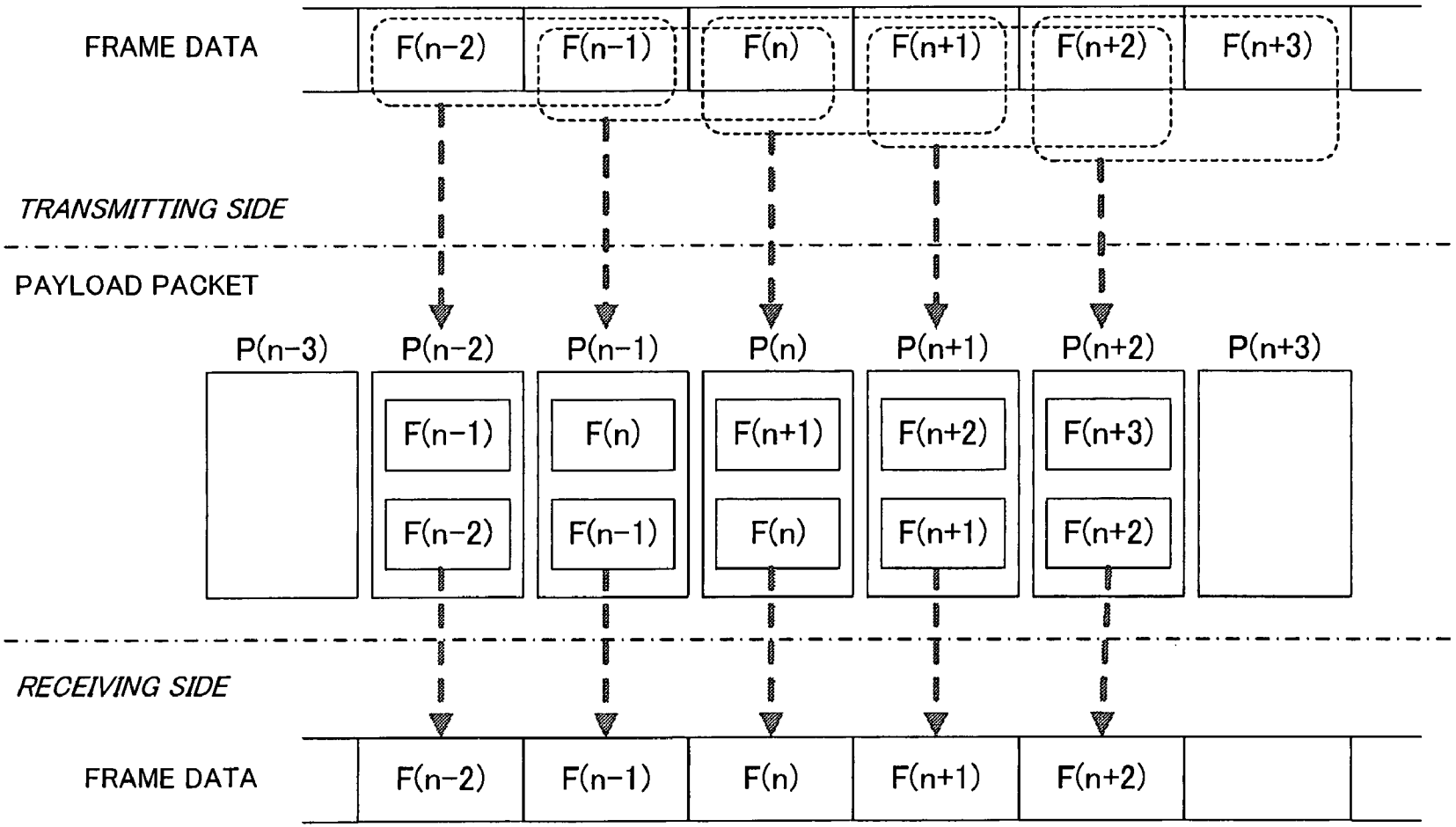
FIG. 1 PRIOR ART
FIG. 1 illustrates a relationship between transmitted/received codes and payload packets in a conventional speech signal transmission system when there is no packet loss.
Figure 2:
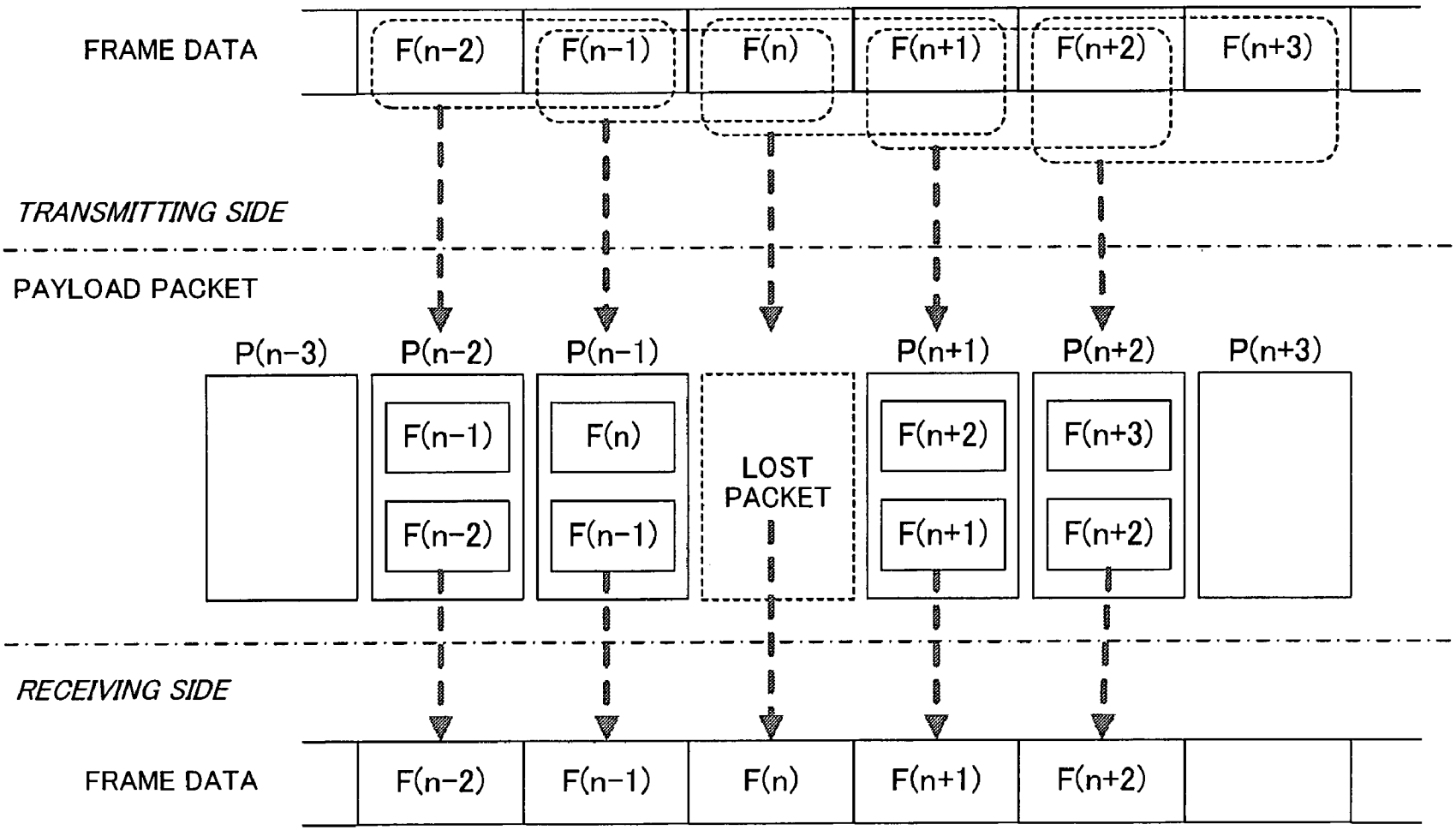
FIG. 2 PRIOR ART
FIG. 2 illustrates a relationship between transmitted/received codes and payload packets of a conventional speech signal transmission system when an nth packet is lost.

When a 12.2 kbit/s AMR scheme is used as speech CODEC, when two or more consecutive packet losses are assumed compared to the conventional method shown in FIG. 2, it has been confirmed that applying the present invention achieves an improvement in the segmental SN ratio of approximately 0.6 dB to 1 dB is obtained (an example of a result with a packet loss rate of 5% to 20%) and the effect is especially noticeable when packet losses occur in a burst-like manner.

As explained above, the present invention can suppress error propagation due to packet losses without any additional transmission delay.

Furthermore, when the speech signal transmission apparatus is provided with a first error calculation section that calculates a first error signal between a target signal and a synthesized signal created by the adaptive codebook, a second error calculation section that calculates a second error signal between the target signal and the synthesized signal created by the fixed codebook, an error signal ratio calculation section that calculates the ratio of the first error signal to the second error signal, a speech frame classifying section that classifies the speech frame according to the magnitude of the ratio, and a decision section that decides whether the second coded information should be multiplexed or not based on the classification result by the speech frame classification section, transmission is performed with second coded information added to only a speech frame which is likely to cause quality degradation due to error propagation caused by packet losses, and therefore it is possible to suppress speech quality degradation due to error propagation at a low average transmission bit rate, allowing efficient transmission of speech signal with high quality.

Furthermore, when the speech signal reception apparatus is provided with a first generation section that generates a first synthesized signal by carrying out concealing processing on a normal packet received immediately after a lost packet, a second generation section that generates a second synthesized signal by decoding the coded information received and a decoding section that outputs a signal obtained by superimposing the first synthesized signal and the second synthesized signal as a decoded signal, it is possible to allow the error propagation caused by a packet loss to converge to one packet immediately after the lost packet, connect the decoded speech signal generated at a lost packet and decoded speech signal decoded and generated at a normal (correctly received) frame immediately after the lost packet smoothly and suppress degradation of the subjective quality of speech.

The present invention is not limited to the above described embodiments, and various variations and modifications may be possible without departing from the scope of the present invention.

This application is based on the Japanese Patent Application No.2003-325001 filed on Sep. 17, 2003, entire content of which is expressly incorporated by reference herein.

What is claimed is:

1. A speech signal transmission apparatus that multiplexes and packetizes first coded information coded in a normal state and second coded information used for improving quality of decoded speech when a frame loss occurs, and sends the packetized information, the speech signal transmission apparatus comprising:

a CELP excitation generating section that comprises an adaptive codebook and a fixed codebook;

a first error calculating section that calculates a first error signal between a target signal and a synthesized signal generated by the adaptive codebook;

a second error calculating section that calculates a second error signal between the target signal and a synthesized signal generated by the fixed codebook;

an error signal ratio calculating section that calculates the ratio of the first error signal to the second error signal;

a speech frame classifying section that classifies a speech frame according to the magnitude of the ratio; and a decision section that decides whether or not to multiplex the second coded information based on the classification result of the speech frame classifying section.

2. A speech signal transmission system comprising:

the speech signal transmission apparatus of claim 1; and a speech signal reception apparatus that receives the packetized information from the speech signal transmission apparatus, depacketizes and demultiplexes the packetized information into the first coded information and the second coded information and carries out, when a packet loss occurs, concealing processing on the lost packet and carries out decoding processing on a packet received immediately after the lost packet using the second coded information.

3. A speech signal transmission method that multiplexes and packetizes first coded information coded in a normal state and second coded information used for improving quality of decoded speech when a frame loss occurs, and sends the packetized information, the speech signal transmission method comprising:

an excitation generating step of generating an excitation signal for a CELP speech coding processing using a synthesized signal generated by an adaptive codebook and a synthesized signal generated by a fixed codebook;

a first error calculating step of calculating a first error signal between a target signal and the synthesized signal generated by the adaptive codebook;

a second error calculating step of calculating a second error signal between the target signal and the synthesized signal generated by the fixed codebook;

an error signal ratio calculating step of calculating the ratio of the first error signal to the second error signal;

a speech frame classifying step of classifying a speech frame according to the magnitude of the ratio; and a decision step of deciding whether or not to multiplex the second coded information based on the classification result of the speech frame classifying step.

* * * * *